US006951991B2

(12) United States Patent
Asada et al.

(10) Patent No.: US 6,951,991 B2
(45) Date of Patent: Oct. 4, 2005

(54) MOVABLE CONTACT FOR A PUSH-ON SWITCH, AND PUSH-ON SWITCH

(75) Inventors: Makoto Asada, Nara (JP); Hirofumi Koizumi, Osaka (JP)

(73) Assignee: Hosident Corporation, Yao (JP)

( * ) Notice: Subject to any disclaimer, the term of this patent is extended or adjusted under 35 U.S.C. 154(b) by 0 days.

(21) Appl. No.: 10/952,923

(22) Filed: Sep. 30, 2004

(65) Prior Publication Data

US 2005/0082156 A1 Apr. 21, 2005

(30) Foreign Application Priority Data

Oct. 16, 2003 (JP) ..... 2003-355884

(51) Int. Cl.[7] ..... H01H 5/18
(52) U.S. Cl. ..... 200/406; 200/516; 200/5 R
(58) Field of Search ..... 200/402, 406–409, 200/468, 510, 516, 5 R, 16 D

(56) References Cited

U.S. PATENT DOCUMENTS

| | | | | |
|---|---|---|---|---|
| 3,941,964 A | * | 3/1976 | Yoder | 200/516 |
| 3,967,084 A | | 6/1976 | Pounds | |
| 4,385,218 A | * | 5/1983 | Nishida | 200/406 |
| 5,079,394 A | | 1/1992 | Torma | |
| 5,199,555 A | * | 4/1993 | Hirano | 200/341 |
| 5,726,400 A | * | 3/1998 | Masuda | 200/16 D |
| 5,939,690 A | * | 8/1999 | Yasui et al. | 200/302.2 |
| 5,947,269 A | | 9/1999 | Miyashita | |
| 6,180,903 B1 | * | 1/2001 | Chen | 200/406 |
| 6,784,382 B2 | * | 8/2004 | Yanai et al. | 200/1 B |

OTHER PUBLICATIONS

Japanese Utility Model Appl. Laying Open No. H03–8827.
Japanese Patent Appl. Laying Open No. H03–89421.
Japanese Utility Model Publ. No. H07–53234.
Japanese Patwent Appl. Laying Open No. H11–232962.
Patent Abstracts of Japan, vol. 1999, No. 13, Nov. 30, 1999, JP 11 232962 A.
Patent Abstracts of Japan, vol. 015, No. 265, Jul. 5, 1991, JP 03 089421 A.

* cited by examiner

*Primary Examiner*—Richard K. Lee
(74) *Attorney, Agent, or Firm*—Bacon & Thomas

(57) ABSTRACT

The invention provides a movable contact for a two-step push-on switch which can realize an excellent sense and a long life period while decreasing the width, even on a flat stationary-contact forming surface of a printed circuit board, a flexible printed circuit board or the like, and also a two-step push-on switch.

A movable contact has: a rectangular annular peripheral plate portion 2; an oval center plate portion 3 which is upward inflatingly curved; and a pair of connecting plate portions 4, 4 which connect an inner edge of the peripheral plate portion 2 to an outer edge of said center plate portion 3 on a center line X which is parallel to long side portions 2*a*, 2*a* of said peripheral plate portion 2. The movable contact is disposed on a flat stationary-contact forming surface of a printed circuit board, a flexible printed circuit board, or the like, and an adhesive tape 9 for fixing the movable contact is bonded from a side of the upper face, thereby configuring a push-on switch.

6 Claims, 3 Drawing Sheets

MOVABLE CONTACT FOR A PUSH-ON SWITCH, AND PUSH-ON SWITCH

BACKGROUND OF THE INVENTION

1. Field of the Invention

The present invention relates to a movable contact for a two-step push-on switch in which first and second switches are sequentially turned ON as a result of a depressing operation, and also to such a push-on switch.

2. Description of the Prior Art

Among two-step push-on switches of this kind, a switch in which first and second movable contacts that are invertable are vertically arranged in two stages (for example, see "Japanese Utility Model Application Laying-Open No. 3-8827") is improved into a switch in which a single movable contact placed in a case is provided with first and second movable contact portions (for example, see "Japanese Patent Application Laying-Open No. 3-89421" "Japanese Utility Model Publication No. 7-53234" and "Japanese Patent Application Laying-Open No. 11-232962"), whereby the number of parts is reduced, the number of man-hours is reduced, and the switch is thinned.

In the improved movable contact of the single-plate configuration, in order to produce a sufficient sense, a case having molded metal terminals must be disposed, and a countermeasure such as that the peripheral portion of the movable contact is fixed, or that a step is formed in a stationary contact must be further taken. Therefore, there arises a problem in that a sufficient sense is hardly obtained in a case of a flat mounting surface such as the case of a printed circuit board (PCB) or a flexible printed circuit board (FPC).

In a case where a switch is to be configured on a side face of a thin electronic apparatus, the size in the width direction must be reduced. In a movable contact which is circular as a whole, and which has a circular annular peripheral plate portion, a circular center plate portion that is upward inflatingly curved, and a connecting plate portion that connects these plate portions together (for example, see Japanese Utility Model Publication No. 7-53234), when the center plate portion has a large diameter, it is possible to attain a long life period, but the width cannot be decreased. By contrast, when the whole diameter is reduced, the width can be decreased, but a long life period of the center plate portion cannot be attained.

The invention has been conducted in view of the above-discussed problems. It is an object of the invention to provide a movable contact for a two-step push-on switch which can realize an excellent sense and a long life period while decreasing the width, even on a flat stationary-contact forming surface of a printed circuit board, a flexible printed circuit board, or the like, and also to provide a two-step push-on switch.

SUMMARY OF THE INVENTION

The movable contact for a push-on switch of the invention has: an annular peripheral plate portion; a center plate portion which is upward inflatingly curved; and connecting plate portions which connect the peripheral plate portion and the center plate portion together, the peripheral plate portion is formed into a rectangular annular shape, a whole circumference of the rectangular annular peripheral plate portion is upward inclined as advancing from an outer side edge toward an inner side edge, grounding parts are formed in four corners of the peripheral plate portion, bent portions which upward protrude are formed in middle portions of long side portions, the connecting plate portions are paired to connect an inner edge of the peripheral plate portion to an outer edge of the center plate portion on a center line which is parallel to the long side portions of the rectangular annular peripheral plate portion, the connecting plate portions are upward inclined as advancing from the peripheral plate portion toward the center plate portion, and, by an operation of depressing the center plate portion, the pair of connecting plate portions are inverted to a downward inclined state to make contact with first stationary contacts which are in a same plane as a support surface of the rectangular annular peripheral plate portion, and a center part of the center plate portion is then inverted to a downward inflated state with using the pair of connecting plate portions as fulcrums to make contact with a second stationary contact which is in a same plane as the support surface of the rectangular annular peripheral plate portion.

The center plate portion is formed into an oval shape that is obtained by cutting away peripheral portions of a circular plate with two straight lines (parallel lines) which are parallel to the long side portions, and a distance between which is shorter than a relative distance between inner side edges of the long side portions, the circular plate having a diameter which is shorter than a relative distance between inner side edges of the short side portions of the rectangular annular peripheral plate portion, and which is longer than the relative distance between the inner side edges of the long side portions.

In the push-on switch of the invention, the movable contact for a push-on switch of the invention is disposed on a flat upper face of a printed circuit board or a flexible printed circuit board, and an adhesive tape for fixing the movable contact is bonded from a side of the upper face. Alternatively, a rectangular recess a depth of which is smaller than a height of the movable contact for a push-on switch of the invention is formed in an upper face of a printed circuit board or a flexible printed circuit board, the movable contact is disposed on a flat bottom face of the recess, and an adhesive tape for fixing the movable contact is bonded from a side of the upper face.

In the movable contact for a push-on switch of the invention, the peripheral plate portion is formed into a rectangular annular shape, and hence the width of the movable contact can be decreased. In succession to a first-step operation in which the pair of connecting plate portions are inverted to a downward inclined state with providing a sense to make contact with the first stationary contacts which are in the same plane as the support surface of the rectangular annular peripheral plate portion, conducted is a second-step operation in which the center part of the center plate portion is inverted to a downward inflated state with providing a sense with using the pair of connecting plate portions as fulcrums to make contact with a second stationary contact which is in the same plane as the support surface of the rectangular annular peripheral plate portion. Even on al flat stationary-contact forming surface of a printed circuit board, a flexible printed circuit board, or the like, therefore, each of the first- and second-step operations can be conducted with producing an excellent sense. Since the center plate portion which functions in the second-step operation is formed into an oval shape, the size in the width direction can be decreased while realizing a long life period (high durability). Therefore, the movable contact for a push-on switch of the invention attains a beneficial advantage that, even on a flat stationary-contact forming surface of a printed circuit board, a flexible printed circuit board, or the like, an excellent sense and a long life period can be obtained while decreasing the width.

In the push-on switch of the invention, the movable contact for a push-on switch of the invention is disposed on the flat upper face of a printed circuit board or a flexible printed circuit board, or on the bottom face of the rectangular recess which is formed in the upper face of a printed circuit board or a flexible printed circuit board, and in which the depth is smaller than the height of the movable contact for a push-on switch of the invention, and the movable contact is fixed by the adhesive tape which is bonded from the side of the upper face. Therefore, the invention attains beneficial advantages that it is possible to provide a two-step push-on switch which has a simple structure, which is economical and very thin, and which can realize an excellent sense and a long life period while decreasing the width, even on a flat stationary-contact forming surface of a printed circuit board, a flexible printed circuit board, or the like, and that it is possible to provide a two-step push-on switch which can be configured even on a side face of a thin electronic apparatus.

DETAILED DESCRIPTION OF THE PREFERRED EMBODIMENT

Figure 1:
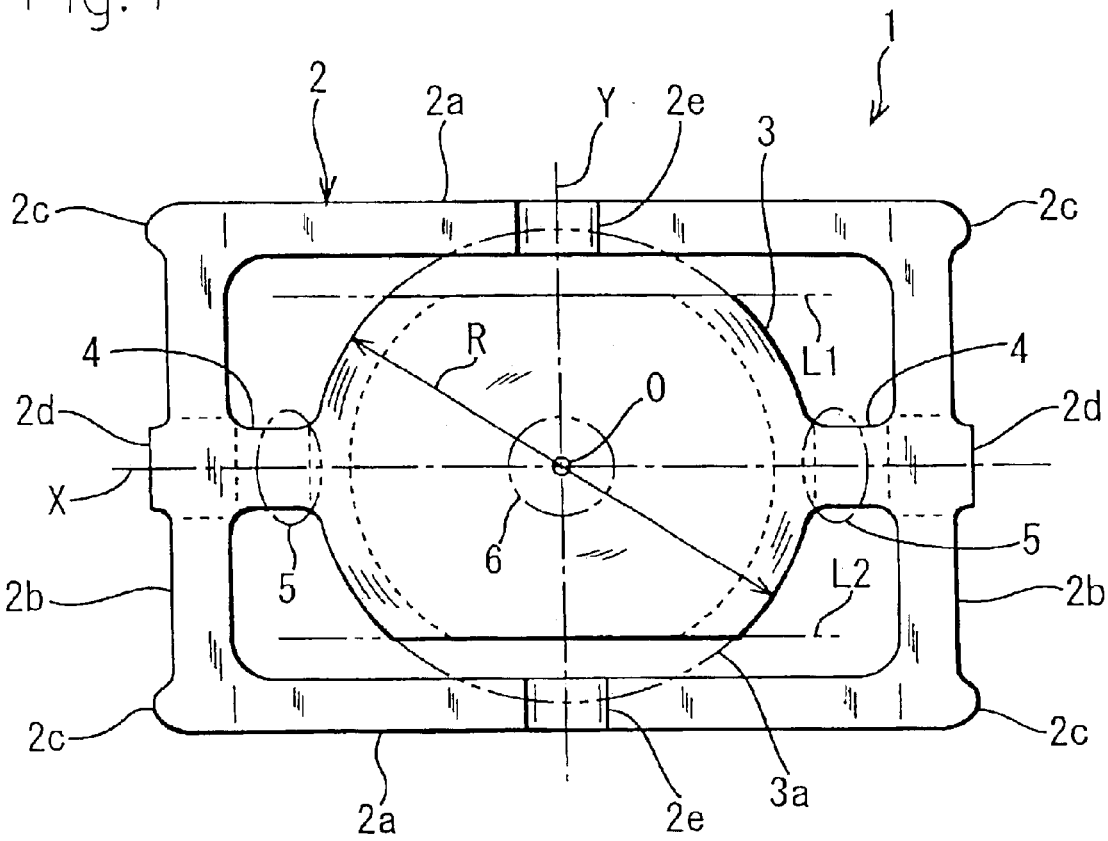
FIG. 1 is a plan view showing a movable contact for a push-on switch of an embodiment.
Figure 2:
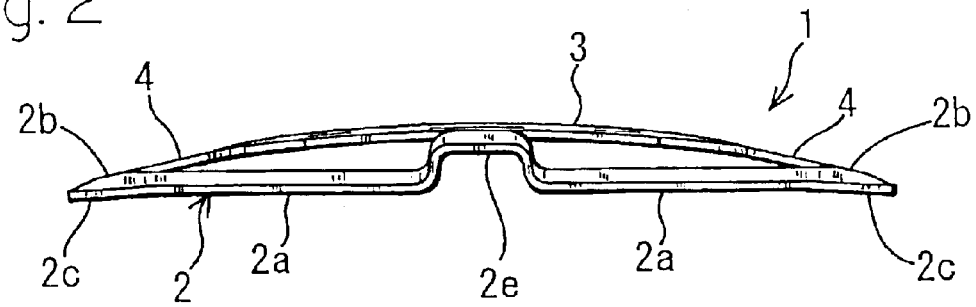
FIG. 2 is a side view showing the movable contact for a push-on switch of the embodiment.

Hereinafter, en embodiment of the invention will be described with reference to the accompanying drawings. FIGS. 1 and 2 show a movable contact of the embodiment. The movable contact 1 is formed by conducting a pressing process on one thin elastic metal plate (a thin plate spring member made of a metal), and has: an annular peripheral plate portion 2; a center plate portion 3 which is upward inflatingly curved; and a pair of narrow-width connecting plate portions 4, 4 which connect these plate portions together. The peripheral plate portion 2 is formed into a rectangular annular frame-like shape. In the peripheral plate portion 2, a pair of long side portions 2*a*, 2*a* and a pair of short side portions 2*b*, 2*b*, i.e., the whole periphery of the peripheral plate portion 2 is upward inclined as advancing from the outer side edge toward the inner side edge. Outer side edges of the end portions and middle portion of the short side portions 2*b*, 2*b* are partially protruded in an obliquely downward direction along the inclination of the short side portions 2*b*, 2*b*, thereby forming grounding parts 2*c*, 2*c*, 2*c*, 2*c*, 2*d*, 2*d* of the movable contact 1. The peripheral plate portion 2 (the movable contact 1) is supported in a state where it is raised from a flat mounting surface by a predetermined height, at a total of six grounding parts, i.e., the four-corner grounding parts 2*c*, 2*c*, 2*c*, 2*c* of the peripheral plate portion 2 which are the four corners of the movable contact 1, and the pair of grounding parts 2*d*, 2*d* on a long direction-center line X of the peripheral plate portion 2 (the movable contact 1) which is parallel to the long side portions 2*a*, 2*a*. In middle portions of the long side portions 2*a*, 2*a*, portions through which a short direction-center line Y of the peripheral plate portion 2 (the movable contact 1) that is parallel to the short side portions 2*b*, 2*b* passes are partially upward protruded to form trapezoidal bent portions 2*e*, 2*e*. The bent portions 2*e*, 2*e* enable the peripheral plate portion 2 to expand and contract in the longitudinal direction, and the upper faces of the bent portions are formed so as to be substantially flush with a curved surface (spherical surface) of the upper face of the center plate portion 3 which will be described later.

The pair of connecting plate portions 4, 4 connect the inner side edge of the peripheral plate portion 2 to the outer peripheral edge of the center plate portion 3 on the long direction-center line X. One end of each of the connecting plate portions is connected to the inner side edge of a middle portion of the corresponding one of the short side portions 2*b*, 2*b* of the peripheral plate portion 2, and the connecting plate portions extend toward the center O (an intersection of the long direction-center line X and the short direction-center line Y) of the peripheral plate portion 2 (the movable contact 1), so that the other ends are connected to the outer peripheral edge of the center plate portion 3. The connecting plate portions 4, 4 are upward inclined as advancing from the peripheral plate portion 2 toward the center plate portion 3 along the inclination of the short side portions 2*b*, 2*b* to which the ends of the connecting plate portions are connected, thereby supporting the center plate portion 3 in a state where it is raised from the peripheral plate portion 2 by a predetermined height. The inclination of the connecting plate portions 4, 4 is set to an angle by which the upward-inclined short side portions 2*b*, 2*b* of the peripheral plate portion 2 are connected to the upward-inclined center plate portion 3 that is upward inflatingly curved, without forming a step or in a substantially flush state.

The center plate portion 3 is formed into an oval shape which is obtained by cutting away peripheral portions of a circular plate 3*a* with two straight lines (parallel lines) L1, L2 which are parallel to the long side portions 2*a*, 2*a* of the peripheral plate portion 2, and the distance between which is shorter than the relative distance between the inner side edges of the long side portions 2*a*, 2*a*. The circular plate 3*a* is upward inflatingly curved, and has a diameter R which is shorter than the relative distance between the inner side edges of the short side portions 2*b*, 2*b* of the peripheral plate portion 2, and which is longer than the relative distance between the inner side edges of the long side portions 2*a*, 2*a*. In a plan view, the center plate portion 3 is concentrically disposed inside the peripheral plate portion 2, in a direction (posture) in which the linear cut edges of the center plate portion 3 elongate along the long side portions 2*a*, 2*a* of the peripheral plate portion 2, and the arcuate uncut edges are opposed to the short side portions 2*b*, 2*b* of the peripheral plate portion 2. Middle portions of the arcuate uncut edges of the center plate portion 3 are connected via the pair of connecting plate portions 4, 4 to the inner side edges of middle portions of the short side portions 2*b*, 2*b* of the peripheral plate portion 2, whereby the center plate portion 3 is supported at a concentric position inside the peripheral plate portion 2 in a plan view.

In the thus configured movable contact 1, the portions of the pair of connecting plate portions 4, 4 which are connected to the center plate portion 3 are formed as first movable contact portions 5, 5, respectively, and the center part of the center plate portion 3 is formed as a second movable contact portion 6.

Figure 3:
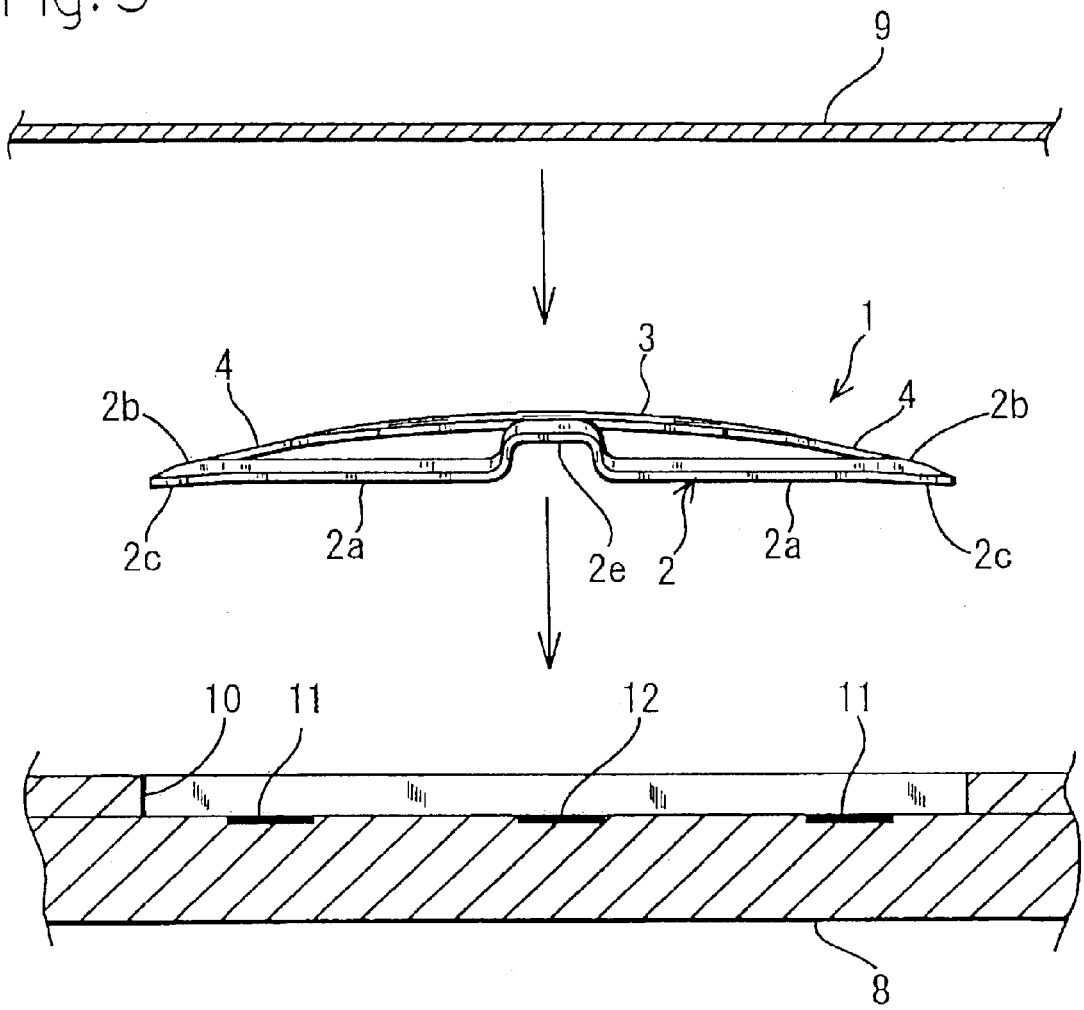
FIG. 3 is a side view showing a disassembled state which is attained before the push-on switch of the embodiment is assembled.
Figure 4:
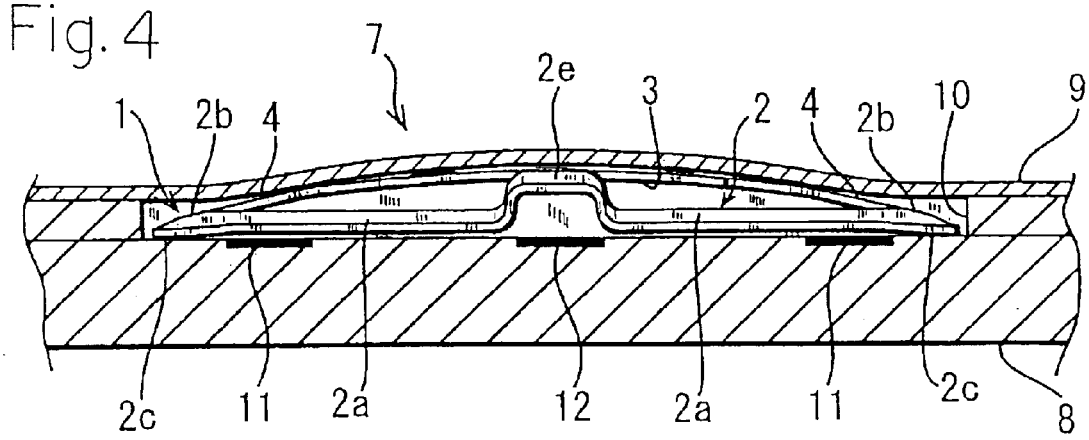
FIG. 4 is a sectional side view showing an assembled state of the push-on switch of the embodiment.
Figure 5A:
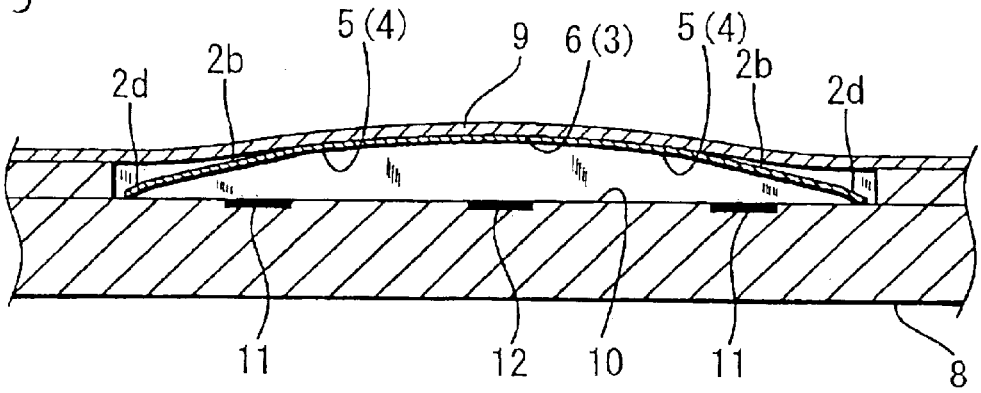
FIG. 5 is a sectional side view showing an operation of the movable contact for a push-on switch of the embodiment.
Figure 5B:
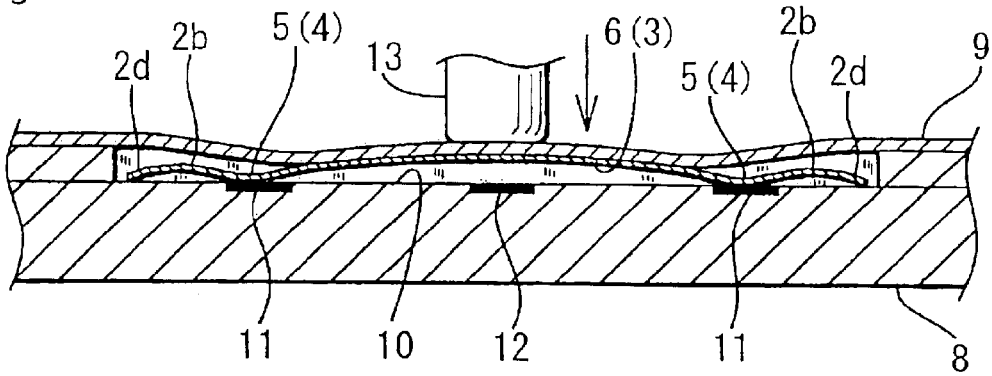
Figure 5C:
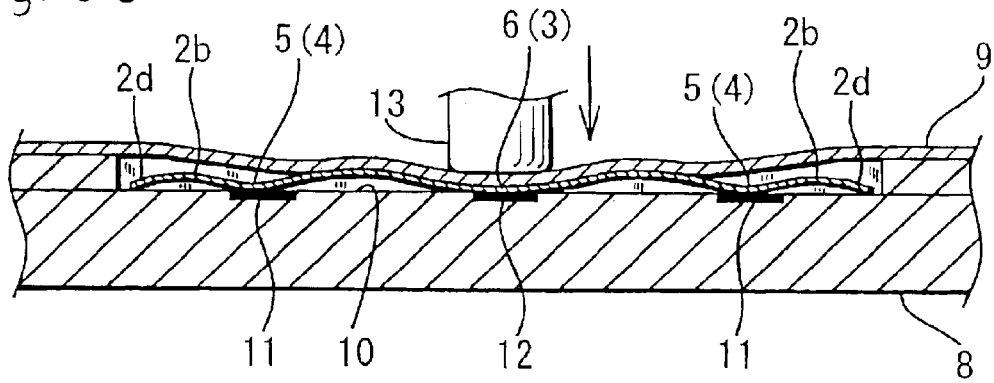

FIG. 4 shows an assembled state of the push-on switch of the embodiment, and FIG. 3 shows a disassembled state which is attained before the assemble. In the push-on switch 7, the movable contact 1 is disposed on a flat upper face of a printed circuit board (PCB) or a flexible printed circuit board (FPC) (hereinafter, referred to as "mounting board") 8, and an insulative adhesive tape 9 for fixing the movable contact 1 is bonded from the side of the upper face, or a rectangular recess 10 the depth of which is smaller than the height of the movable contact 1, and which is larger than the peripheral plate portion 2 of the movable contact 1 is formed in the upper face of the mounting board 8, the movable contact 1 is disposed on a flat bottom face of the recess 10, and an adhesive tape 9 for fixing the movable contact 1 is bonded from the side of the upper face, thereby completing the push-on switch 7. FIGS. 3 to 5 show the push-on switch 7 of the latter embodiment. The flat upper face or the flat bottom face of the recess 10 functioning as the movable contact support surface of the mounting board 8 to which the grounding parts 2*c*, 2*c*, 2*c*, 2*c*, 2*d*, 2*d* of the peripheral plate portion 2 of the movable contact 1 are grounded functions also as a stationary-contact forming surface corresponding to the movable contact 1. First stationary contacts 11, 11 corresponding to the first movable contact portions 5, 5 of the movable contact 1, and a second stationary contact 12 corresponding to the second movable contact portion 6 are exposedly formed so as to be flush with one another.

The operation of the movable contact 1 in the push-on switch 7 will be described with reference to FIG. 5. In an initial state, as shown in (a) of FIG. 5, the movable contact 1 is separated from and opposed to the first stationary contacts 11, 11 and the second stationary contact 12. When, in order to turn ON the push-on switch 7, the center plate portion 3 of the movable contact 1 is depressed by a press operating member 13 from the side above the adhesive tape 9, the center plate portion 3 is first depressed while maintaining the upward inflatingly curved state. In accordance with the depressing operation, while the long side portions 2*a*, 2*a* of the peripheral plate portion 2 are down-ward flexurally deformed, the connecting plate portions 4, 4 which are upward inclined as advancing from the peripheral plate portion 2 toward the center plate portion 3 fall down with being bent in the portions where the connecting plate portions are connected to the center plate portion 3. In the initial stage of the falling operation of the connecting plate portions 4, 4, the short side portions 2*b*, 2*b* of the peripheral plate portion 2 which is formed into a rectangular annular shape are pressed from the inner side toward the outer side, whereby the peripheral plate portion 2 is extended in the longitudinal direction while expandingly deforming the bent portions 2*e*, 2*e* formed in the middle portions of the long side portions 2*a*, 2*a*. After a timing when the connecting plate portions 4, 4 exceed a horizontal posture, then, the connecting plate portions 4, 4 are rapidly inverted (elastically deformed) to a downward inclined posture by the assistance of the elasticity of the peripheral plate portion 2 in which the portion tries to contract by a degree corresponding to the longitudinal elongation. As shown in (b) of FIG. 5, the first movable contact portions 5, 5 in the portions where the connecting plate portions 4, 4 are connected to the center plate portion 3 make contact while providing an excellent sense with the first stationary contacts 11, 11 which are in the same plane as the supporting surface of the peripheral plate portion 2, thereby producing an ON state of a first switch. In the embodiment, the pair of connecting plate portions 4, 4 connect the inner side edge of the peripheral plate portion 2 to the outer peripheral edge of the center plate portion 3 on the long direction-center line X. Therefore, the operation stroke for the first step can be sufficiently ensured, and a more excellent sense is produced in the first step. Although the operation stroke for the first step is sufficiently ensured to produce an excellent sense in the first step, the width is not increased, but decreased.

When, in the ON state of the first switch, the center plate portion 3 of the movable contact 1 is further depressed by the press operating member 13, the center part of the center plate portion 3 which is supported by the first movable contact portions 5, 5 in the portions where the connecting plate portions 4, 4 are connected to the center plate portion 3 is rapidly inverted to a downward inflated state, and inverted (elastically deformed) to a downward inflated state while producing a click sensation, at a timing when the center part cannot withstand the depressing force. As shown in (c) of FIG. 5, the second movable contact portion 6 in the center part of the center plate portion 3 makes contact while providing an excellent sense with the second stationary contact 12 which is on the same plane as the supporting surface of the peripheral plate portion 2, thereby producing an ON state of a second switch.

When the depressing force applied to the center plate portion 3 of the movable contact 1 by the press operating member 13 is then cancelled, the center part of the center plate portion 3 is first caused by the elasticity to be restored to the upward inflated state, whereby the second movable contact portion 6 is separated from the second stationary contact 12, so that the second switch is returned to the state of (b) of FIG. 5 or the OFF state. Subsequently, the connecting plate portions 4, 4 are restored to the upward inclined state, and the peripheral plate portion 2 contracts by a degree corresponding to the longitudinal elongation, whereby the first movable contact portions 5, 5 are separated from the first stationary contacts 11, 11, respectively, so that both the first and second switches shown in (a) of FIG. 5 are returned to the OFF state.

As described above, in the movable contact 1 for a push-on switch of the embodiment, the peripheral plate portion is formed into a rectangular annular shape, and hence the width of the movable contact 1 can be decreased. In succession to the first-step operation in which the pair of connecting plate portions 4, 4 are inverted to the downward inclined state with providing a sense to make contact with the first stationary contacts 11, 11 which are in the same plane as the support surface of the rectangular annular peripheral plate portion 2, conducted is the second-step operation in which the center part of the center plate portion 3 is inverted to the downward inflated state with providing a sense with using the pair of connecting plate portions 4, 4 as fulcrums to make contact with the second stationary contact 12 which is in the same plane as the support surface of the rectangular annular peripheral plate portion 3. Even on the flat stationary-contact forming surface of the mounting board 8, therefore, each of the first- and second-step operations can be conducted with producing an excellent sense. Since the center plate portion 3 which functions in the second-step operation is formed into an oval shape, the size in the width direction can be decreased while realizing a long life period (high durability).

In the push-on switch 7 of the embodiment, the movable contact 1 is disposed on the flat upper face of the mounting board 8, or on the bottom face of the rectangular recess 10 which is formed in the upper face of the mounting board 8, and in which the depth is smaller than the height of the movable contact 1, and the movable contact is fixed by the adhesive tape 9 which is bonded from the side of the upper face. Therefore, the push-on switch has a simple structure which is economical and very thin, and which can realize an excellent sense and a long life period while decreasing the width, even on the flat stationary-contact forming surface of the mounting board 8. The push-on switch 7 can be configured even on a small-width side face of a thin electronic apparatus.

In place of the configuration in which the movable contact 1 is bonded to a flat stationary-contact forming surface of a printed circuit board or a flexible printed circuit board, another configuration in which the fixing adhesive tape 9 is bonded to a resin molded product having metal terminals for forming the stationary contacts 11, 11, 12 may be employed. According to the configuration, it is possible to form also a push-on switch which can be surface-mounted on a printed circuit board or a flexible printed circuit board.

What is claimed is:

1. A movable contact for a push-on switch, having: an annular peripheral plate portion 2; a center plate portion 3 which is upward inflatingly curved; and connecting plate portions 4, 4 which connect said peripheral plate portion and said center plate portion together, wherein said peripheral plate portion 2 is formed into a rectangular annular shape, a whole circumference of said rectangular annular peripheral plate portion 2 is upward inclined as advancing from an outer side edge toward an inner side edge, grounding parts 2*c*, 2*c*, 2*c*, 2*c* are formed in four corners of said peripheral plate portion, bent portions 2*e*, 2*e* which upward protrude are formed in middle portions of long side portions 2*a*, 2*a*, said connecting plate portions 4, 4 are paired to connect an inner edge of the peripheral plate portion 2 to an outer edge of said center plate portion 3 on a center line X which is parallel to said long side portions 2*a*, 2*a* of said rectangular annular peripheral plate portion 2, said connecting plate portions 4, 4 are upward inclined as advancing from said peripheral plate portion 2 toward said center plate portion 3, and, by an operation of depressing said center plate portion 3, said pair of connecting plate portions 4, 4 are inverted to a downward inclined state to make contact with first stationary contacts 11, 11 which are in a same plane as a support surface of said rectangular annular peripheral plate portion 2, and a center part of said center plate portion 3 is then inverted to a downward inflated state with using said pair of connecting plate portions 4, 4 as fulcrums to make contact with a second stationary contact 12 which is in a same plane as the support surface of said rectangular annular peripheral plate portion 2.

2. A movable contact for a push-on switch according to claim 1, wherein said center plate portion 3 is formed into an oval shape that is obtained by cutting away peripheral portions of a circular plate 3*a* with two straight lines L1, L2 which are parallel to said long side portions 2*a*, 2*a*, and a distance between which is shorter than a relative distance between inner side edges of said long side portions 2*a*, 2*a*, said circular plate having a diameter R which is shorter than a relative distance between inner side edges of said short side portions 2*b*, 2*b* of said rectangular annular peripheral plate portion 2, and which is longer than the relative distance between the inner side edges of said long side portions 2*a*, 2*a*.

3. A push-on switch wherein a rectangular recess 10 a depth of which is smaller than a height of a movable contact according to claim 2 is formed in an upper face of a printed circuit board 8 or a flexible printed circuit board 8, said movable contact is disposed on a flat bottom face of said recess 10, and an adhesive tape 9 for fixing said movable contact is bonded from a side of the upper face.

4. A push-on switch wherein a movable contact according to claim 1 is disposed on a flat upper face of a printed circuit board 8 or a flexible printed circuit board 8, and an adhesive tape 9 for fixing said movable contact is bonded from a side of the upper face.

5. A push-on switch wherein a rectangular recess 10 a depth of which is smaller than a height of a movable contact according to claim 1 is formed in an upper face of a printed circuit board 8 or a flexible printed circuit board 8, said movable contact is disposed on a flat bottom face of said recess 10, and an adhesive tape 9 for fixing said movable contact is bonded from a side of the upper face.

6. A push-on switch wherein a movable contact according to claim 1 is disposed on a flat upper face of a printed circuit board 8 or a flexible printed circuit board 8, and an adhesive tape 9 for fixing said movable contact is bonded from a side of the upper face.

* * * * *

UNITED STATES PATENT AND TRADEMARK OFFICE

CERTIFICATE OF CORRECTION

PATENT NO. : 6,951,991 B2
APPLICATION NO. : 10/952923
DATED : October 4, 2005
INVENTOR(S) : Makoto Asada et al.

It is certified that error appears in the above-identified patent and that said Letters Patent is hereby corrected as shown below:

On Title Page, Item (73) Assignee name , "Hosident Corporation" is incorrectly spelled, it should be corrected to read as: -- Hosiden Corporation --

Signed and Sealed this

Eighth Day of May, 2007

JON W. DUDAS
*Director of the United States Patent and Trademark Office*